US007288020B1

(12) United States Patent
Kiku

(10) Patent No.: US 7,288,020 B1
(45) Date of Patent: Oct. 30, 2007

(54) METHOD OF BLASTING PROCESS

(75) Inventor: Taiji Kiku, Handa (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 11/678,711

(22) Filed: Feb. 26, 2007

Related U.S. Application Data

(60) Provisional application No. 60/778,749, filed on Mar. 3, 2006.

(51) Int. Cl.
*B24C 1/00* (2006.01)

(52) U.S. Cl. ..... 451/38; 134/7

(58) Field of Classification Search ..... 451/38, 451/39, 40, 28, 75; 134/6, 7, 902
See application file for complete search history.

(56) References Cited

U.S. PATENT DOCUMENTS

2002/0168867 A1* 11/2002 Haerle et al. ..... 438/758
2003/0162483 A1* 8/2003 Saka et al. ..... 451/41

FOREIGN PATENT DOCUMENTS

JP 2002-028599 A1 1/2002
JP 2005-193308 A1 7/2005

* cited by examiner

*Primary Examiner*—Jacob K. Ackun, Jr.
(74) *Attorney, Agent, or Firm*—Burr & Brown

(57) ABSTRACT

Disclosed is a blast processing method for removing a deposit adhered onto a surface of a ceramic heater formed of aluminum nitride by blowing a blasting material onto the surface. Abrasive grains made of silicon carbide or aluminum oxide and having a grain size of #400 to #800 are used as the blasting material, and a blast pressure as a pressure when the blasting material collides with the surface of the ceramic heater is set at 40 to 150 gf/cm$^2$.

4 Claims, 3 Drawing Sheets

METHOD OF BLASTING PROCESS

CROSS REFERENCE TO RELATED APPLICATIONS

This application is based upon and claims the benefit of priority from prior U.S. Provisional Application No. 60/778,749, filed on Mar. 3, 2006; the entire contents of which are incorporated herein by reference.

BACKGROUND OF THE INVENTION

1. Field of the Invention

The present invention relates to a blast processing method, and more specifically, to a blast processing method for removing a deposit adhered onto a component part of a semiconductor manufacturing apparatus.

2. Description of the Related Art

In usual, in manufacture of a semiconductor device, various films such as a silicon oxide film are formed on a wafer by using a semiconductor manufacturing apparatus.

In a step of generating the films, a deposition is sometimes adhered onto a heater, an electrostatic chuck, or a susceptor, which constructs the semiconductor manufacturing apparatus. When the deposition is adhered onto the heater or the susceptor, uniform heating performance for the wafer is decreased, and reproducibility of device characteristics or the like is reduced. Moreover, when the deposition is adhered onto the electrostatic chuck, sufficient electrostatic suction force is not generated, and surface roughness thereof or the like is changed to change a degree of contact of the electrostatic chuck with the wafer and a way of heat transfer therefrom to the wafer. Thus, the uniform heating performance for the wafer at a time of plasma heat input is decreased, and the reproducibility of the device characteristics or the like is reduced.

Therefore, process of periodically removing the deposit adhered onto such a component part of the semiconductor manufacturing apparatus has been heretofore performed (for example, refer to Japanese Patent Laid-Open Publication Nos. 2002-28599 and 2005-193308).

However, though a deposit removal method described in a related art of Japanese Patent Laid-Open Publication No. 2002-28599 is a method of blowing blasting beads to such a processing object, there has been an apprehension that the blasting beads may remain on the processing object, resulting in being a particulate contamination source.

Moreover, a deposit removal method disclosed in Japanese Patent Laid-Open Publication No. 2005-193308 is a method of blowing a blasting material to the processing object. However, since a pressure and the like at a time of blowing the blasting material are not regulated, there has been an apprehension that such a problem may occur that a surface of the processing object is damaged when the pressure is too large.

SUMMARY OF THE INVENTION

It is an object of the present invention to provide a blast processing method capable of certainly removing the deposit without damaging the surface of the processing object.

In order to achieve the above-described object, the present invention is a blast processing method for blowing a blasting material onto a surface of a processing object formed of aluminum nitride and removing a deposit adhered onto the surface, characterized in that abrasive grains made of silicon carbide or aluminum oxide and having a grain size of #400 to #800 are used as the blasting material, and a blast pressure as a pressure when the blasting material collides with the surface of the processing object is set at 40 to 150 gf/cm$^2$.

In accordance with the blast processing method according to the present invention, only the deposit adhered onto the surface can be removed without damaging the surface of the processing object. Moreover, even after the blast processing, the blasting material hardly remains on the surface.

DETAILED DESCRIPTION OF THE EMBODIMENTS

A description will be made below of an embodiment of the present invention.

[Processing Object]

In this embodiment, for a processing object, a member made of aluminum nitride (AlN) is used. For example, as the processing object, a component part of a semiconductor manufacturing apparatus, such as a ceramic heater, an electrostatic chuck, and a susceptor, can be employed.

Figure 1:
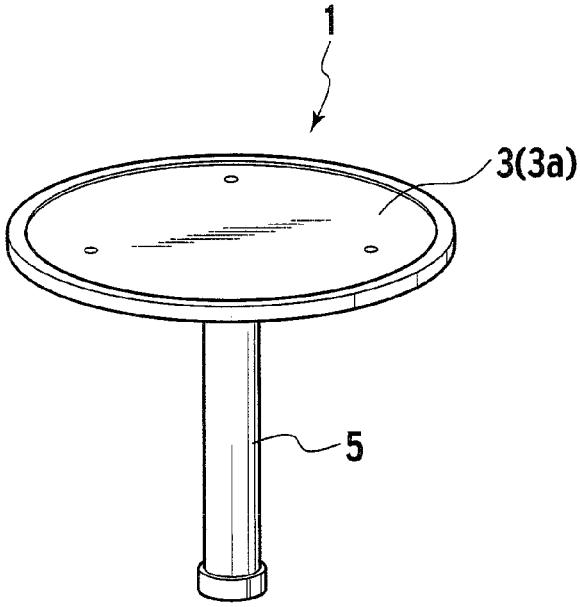
FIG. 1 is a perspective view showing a ceramic heater as a processing object for use in an embodiment of the present invention.

FIG. 1 is a perspective view showing a ceramic heater 1 as the processing object for use in the embodiment of the present invention. The ceramic heater 1 is composed of a disc-like plate member 3 disposed on an upper side thereof, and a thin cylindrical shaft 5 joined to a lower surface of the plate member 3. Then, since a deposition is adhered onto a surface 3*a* of the plate member 3, blast processing is implemented for the surface 3*a*.

[Blasting Material]

As the blasting material, abrasive grains are used, which are made of silicon carbide (SiC) or aluminum oxide ($Al_2O_3$), and have a grain size of #400 to #800. When the grain size is less than #400, there is a problem that fine irregularities are formed on the surface 3*a* of the plate member 3, resulting in a decrease of uniform heating performance of the processing object. Meanwhile, when the grain size is larger than #800, there is a problem that it takes very long to perform the processing since it becomes difficult to sufficiently remove the deposit on the plate member 3.

[Blast Processing Apparatus]

Figure 2:
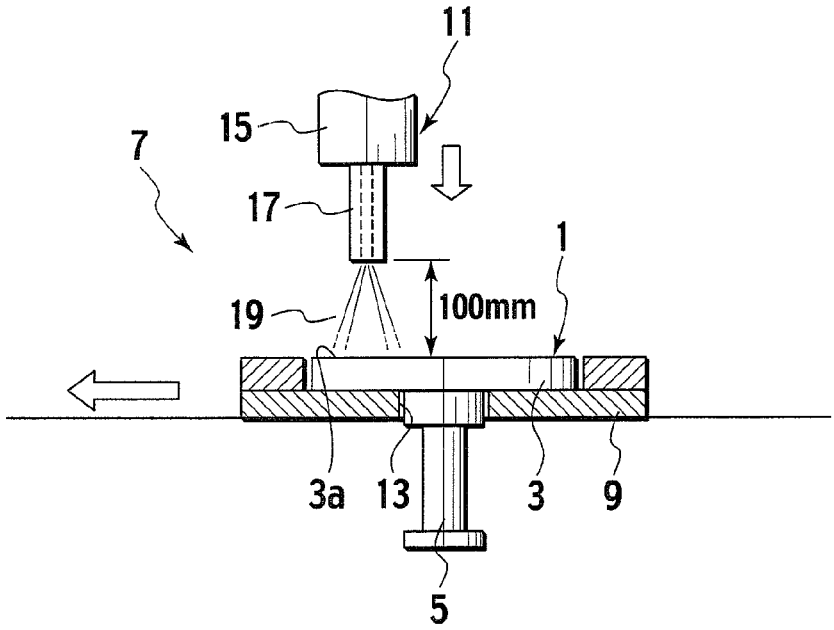
FIG. 2 is a side view showing a state of implementing blast processing for a surface of the ceramic heater.

As shown in FIG. 2, a blast processing apparatus 7 according to this embodiment includes a mounting stage 9 mounting thereon the ceramic heater 1 as the processing object, and blowing means 11 disposed above the mounting stage 9.

Figure 5:
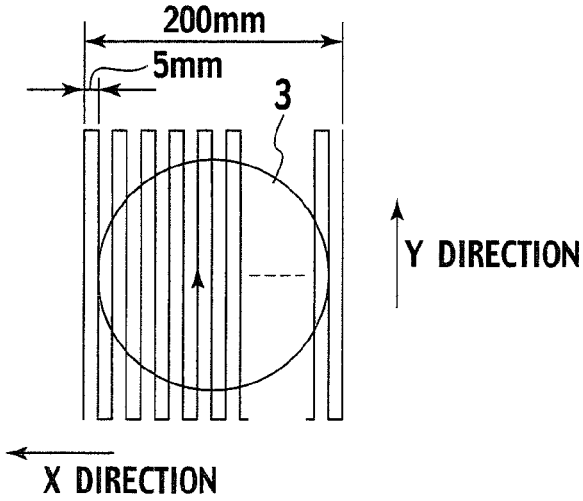
FIG. 5 is a schematic view showing a relationship between a moving route of blowing means for blowing the blasting material and the ceramic heater.

As shown in FIG. 2 and FIG. 5, the mounting stage 9 is configured to run in a x-direction and a y-direction on a substantially horizontal plane. This x-direction is at right angles with the y-direction.

The blowing means 11 is configured to run in the x-direction, the y-direction and up and down. These mounting stage 9 and blowing means 11 are configured to run individually.

An insertion hole 13 is drilled in a center portion of the mounting stage 9, and a shaft member 5 of the ceramic heater 1 is inserted into the insertion hole 13. Moreover, the lower surface of the plate member 3 is made to abut on an upper surface of the mounting stage 9, and the ceramic heater 1 is thus mounted on the mounting stage 9.

Moreover, as shown in FIG. 2, the blowing means 11 includes a main body 15 and nozzle portions 17 provided on a tip end of the main body 15. A blasting material 19 is jetted from tip ends of the nozzle portions 17.

Figure 3:
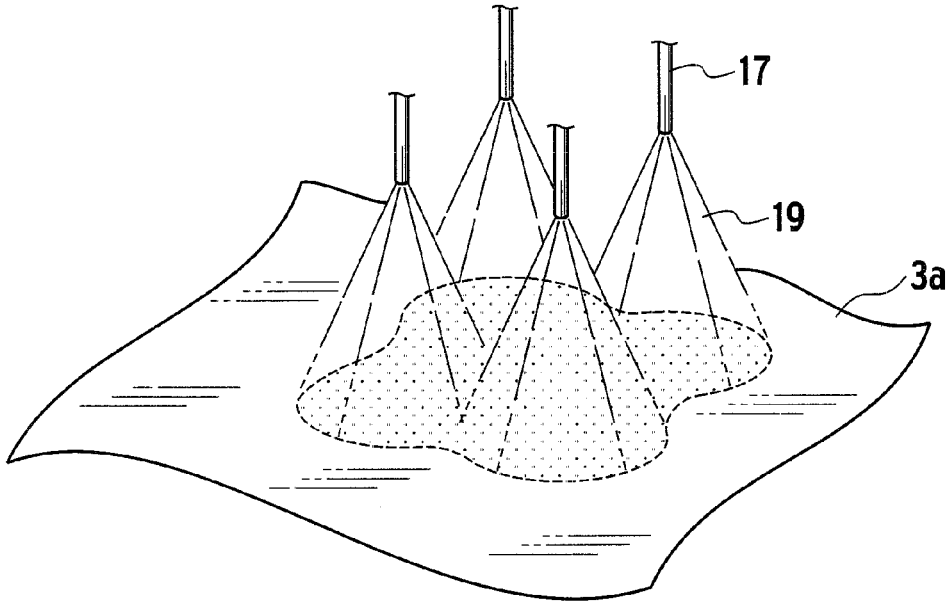
FIG. 3 is a perspective view schematically showing a state of implementing the blast processing for the surface of the ceramic heater.

Specifically, as shown in FIG. 3, four pieces of the nozzle portions 17 are provided, and the blasting material is jetted in a conical shape from the tip ends of the respective nozzle portions 17.

Figure 4:
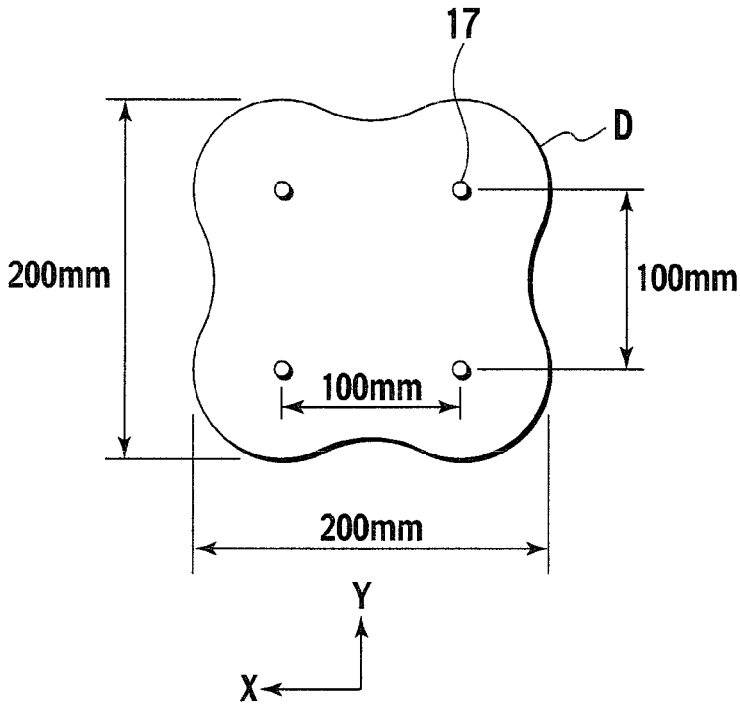
FIG. 4 is a schematic view showing a distribution range of a blasting material on the surface of the ceramic heater.

Hence, as shown in FIG. 4, the four nozzle portions 17 are arranged on apex portions of a square since the respective nozzle portions 17 are arranged so as to be spaced from one another at an equal interval (for example, by 100 mm) in an X-direction and a Y-direction. Hence, when viewed from the above, a distribution range D of the blasting material 19 blown to the surface 3*a* of the plate member 3 is formed into a substantial square in which a length of each side is, for example, 200 mm.

[Blast Processing Condition]

In this embodiment, a blast pressure as a pressure when the blasting material 19 collides with the surface 3*a* of the plate member 3 (processing object) is set at 40 to 150 gf/cm$^2$. The blast pressure is a pressure which the plate member 3 receives from the blasting member 3 by the fact that the blasting material 19 and gas are blown to the surface 3*a* of the plate member 3.

When the blast pressure is less than 40 gf/cm$^2$, the problem is present that it takes very long to perform the processing since it becomes difficult to sufficiently remove the deposit on the plate member 3. Meanwhile, when the blast pressure exceeds 150 gf/cm$^2$, there is an apprehension that the surface 3*a* of the plate member 3 may be damaged. When the surface 3*a* is damaged, the fine irregularities are formed on the surface 3*a*, and the uniform heating performance is thus decreased, and accordingly, this is not preferable.

Note that, more preferably, the blast pressure is 60 to 100 gf/cm$^2$.

Moreover, it is preferable that a moving speed of the nozzle portions 17 be 5 to 15 cm/min, and it is preferable that a distance from the tip ends of the nozzle portions 17 to the surface 3*a* of the processing object be 6 to 12 cm.

[Blowing Amount of Blasting Material]

On the surface 3*a* of the plate member 3 of the ceramic heater 1 as the processing object, it is preferable to set a blowing amount of the blasting material 19 per unit area at 1.4 to 4.3 g/cm$^2$.

When the blowing amount is less than 1.4 g/cm$^2$, it takes very long to perform the processing since it becomes difficult to sufficiently remove the deposit on the plate member 3. Meanwhile, when the blowing amount is larger than 4.3 g/cm$^2$, the fine irregularities are formed on the surface 3*a* of the plate member 3, resulting in the decrease of the uniform heating performance.

Note that, more preferably, the blowing amount is 1.7 to 2.8 g/cm$^2$.

Subsequently, a description will be briefly made below of a calculation method for calculating the blowing amount of the blasting material 19 by using FIG. 5.

A blowing amount per square millimeter on the surface 3*a* of the plate member 3 is represented as Q [g/mm$^2$]. A total time of blowing the blasting material 19 is represented as T [sec]. A blowing amount of blowing the blasting material 19 for one second per square millimeter on the surface 3*a* of the plate member 3 is represented as q [g/sec·mm$^2$. The moving speed of the nozzle portions 17 is represented as V [mm/sec]. A length of one pass of each of the nozzle portions 17 is defined as 200 [mm]. A moving time of each nozzle portion 17 per pass is represented as t [sec]. An amount of the blasting material 19 supplied to the nozzle portions 17 for one second is represented as G [g/sec].

First, the blowing amount Q per square millimeter on the surface 3*a* of the plate member 3 is obtained by the following calculating expression:

$$Q=T\times q \quad \text{(Expression 1)}$$

Here, T just needs to be obtained by multiplying the moving time per pass by the number of passes. When one pass is ended, each nozzle portion 17 laterally shifts by a predetermined distance (for example, 5 mm) to transfer to the next pass. Accordingly, a sum of the number of passes for processing the plate member 3 is obtained as:

$$200\ [\text{mm}]/5\ [\text{mm}]=40\ [\text{times}]$$

Hence, the following calculating expression is established:

$$T=(200/V)\times(200/5)=8000/V \quad \text{(Expression 2)}$$

Moreover, the blowing amount q of blowing the blasting material 19 for one second per square millimeter on the surface 3*a* of the plate member 3 is obtained by the following calculating expression.

$$q=G/(200\times 200)=G/40000 \quad \text{(Expression 3)}$$

When Expression 2 and Expression 3 are substituted into Expression 1 described above, the following calculating expression is established:

$$Q=T\times q=(8000/V)\times(G/40000)=G/5V\ [\text{g/mm}^2] \quad \text{(Expression 4)}$$

[Blast Processing Method]

A description will be made of a procedure of implementing the blast processing for the ceramic heater 1 as the processing object.

First, as shown in FIG. 2, the ceramic heater 1 is mounted on the mounting stage 9, and the blowing means 11 is moved down, and held at a position above the surface 3*a* of the plate member 3, which is spaced therefrom by a predetermined distance (for example, 100 mm).

Subsequently, as shown in FIG. 5, at the same height, the blowing means 11 is moved horizontally and linearly in the Y-direction at the speed V [mm/sec].

Then, such a horizontal movement is stopped at an endpoint of the movement, and in this state, the mounting stage 9 is shifted in the X-direction by the predetermined distance (for example, 5 mm). Thereafter, the blowing means 11 is horizontally moved in a direction (in the Y-direction) reverse to the previous moving direction. By repeating such operations, the blast processing by a predetermined number of passes (for example, 40 passes) is performed.

After the blast processing is ended, the surface 3*a* of the plate member 3 is ultrasonically washed with pure water and isopropyl alcohol (IPA), followed by drying.

A description will be made below of functions and effects, which are brought by the embodiment of the present invention.

In accordance with the blast processing method according to this embodiment, as the blasting material, the abrasive grains are used, which are made of silicon carbide or aluminum oxide, and have a grain size of #400 to #800. Moreover, the blast pressure as the pressure when the blasting material collides with the surface 3*a* of the plate member 3 of the ceramic heater 1 as the processing object is set at 40 to 150 gf/cm$^2$. Accordingly, the surface 3*a* is not damaged even after the blast processing, and therefore, the uniform heating performance of the used ceramic heater 1 returns to an initial state thereof where the ceramic heater 1 is unused. Hence, the ceramic heater 1 can be suitably reused. Note that the blast processing method according to this embodiment can also be applied to the susceptor and the electrostatic chuck, which are the processing objects, as well as the ceramic heater 1.

When, as the processing object, the electrostatic chuck is subjected to the processing, suction force thereof and a degree of contact thereof with a wafer when the electrostatic chuck sucks the wafer are restored to a state where the electrostatic chuck is unused. In such a way, a temperature distribution of the electrostatic chuck becomes normal, and uniform heating performance thereof becomes equivalent to that in an initial state.

EXAMPLES

A description will be made below of the present invention through examples more specifically.

Example 1

First, as the processing object, the ceramic heater 1 made of aluminum nitride, of which size is Ø300 mm, was prepared. By using the ceramic heater 1, 10,000 wafers were processed by CVD processing. As a result, the uniform heating performance for the wafers at a heating temperature of 500° C. was decreased by 5° C. as compared with that in an initial state. Here, the uniform heating performance for the wafers refers to a difference between the highest temperature and the lowest temperature on each wafer. It is conceived that the decrease of the uniform heating performance occurred since the deposition was adhered onto the ceramic heater 1.

The blast processing according to the present invention was implemented for the ceramic heater 1 that had processed 10,000 wafers.

First, as shown in FIG. 2, the ceramic heater 1 was mounted on the mounting stage 9, the blowing means 11 was moved down, and lower ends of the nozzle portions 17 were held at a height of 100 mm from the surface 3*a* of the plate member 3.

Then, the blasting material 19 was jetted from the nozzle portions 17 while horizontally moving the blowing means 11 in the Y-direction. Here, the nozzle portions 17 were arranged so as to be spaced by 100 mm from one another in the X-direction and the Y-direction. Then, as shown in FIG. 4, the distribution range D of the blasting material 19 on the surface 3*a* of the plate member 3 was formed into the substantial square in which the length of each side was 200 mm.

Subsequently, the blowing means 11 was held at the terminal end, and the mounting stage 9 was moved in a sliding manner in the X-direction by 5 mm. Thereafter, the blowing means 11 was turned back in the (−Y)-direction, and was moved horizontally. Such operations were repeated. Then, as shown in FIG. 5, a relative movement obit of each nozzle portion 17 with respect to the plate member 3 was made into a plurality of rectangular shapes. Then, at the time when the number of passes reached 40 times, the blowing was ended.

Note that a setting was made so that each blowing amount per unit area on the surface 3*a* of the plate member 3 could be uniform with those of the others. Moreover, a supply amount per unit time of the blasting material 19 supplied to one nozzle portion 17 was set at 2.67 μg/sec].

Processing conditions in the above-described blast processing are shown in Table 1 to be shown below.

TABLE 1

| | Blast pressure (gf/cm$^2$) | Nozzle moving speed (cm/sec) | Amount of blown sand per unit area (g/cm$^2$) | Distance from nozzle end to processing object surface (cm) | Type of blasting material | Grain size of blasting material | Vacation of uniform heating performance (° C.) |
|---|---|---|---|---|---|---|---|
| Present invention example 1 | 40 | 10 | 2.1 | 10 | SiC | #600 | 1.0 |
| Present invention example 2 | 80 | 10 | 2.1 | 10 | SiC | #600 | 0.7 |
| Present invention example 3 | 120 | 10 | 2.1 | 10 | SiC | #600 | 1.0 |
| Present invention example 4 | 150 | 10 | 2.1 | 10 | SiC | #600 | 1.3 |
| Present invention example 5 | 80 | 15 | 1.4 | 10 | SiC | #600 | 1.0 |
| Present invention | 80 | 12 | 1.8 | 10 | SiC | #600 | 0.7 |

TABLE 1-continued

| | Blast pressure ($gf/cm^2$) | Nozzle moving speed (cm/sec) | Amount of blown sand per unit area ($g/cm^2$) | Distance from nozzle end to processing object surface (cm) | Type of blasting material | Grain size of blasting material | Vacation of uniform heating performance (° C.) |
|---|---|---|---|---|---|---|---|
| example 6 | | | | | | | |
| Present invention example 7 | 80 | 10 | 2 1 | 10 | SiC | #600 | 0.7 |
| Present invention example 8 | 80 | 8 | 2.7 | 10 | SiC | #600 | 1.3 |
| Present invention example 9 | 80 | 5 | 4.3 | 10 | SiC | #600 | 1.7 |
| Present invention example 10 | 80 | 10 | 2.1 | 6 | SiC | #600 | 1.3 |
| Present invention example 11 | 80 | 10 | 2.1 | 8 | SiC | #600 | 1.3 |
| Present invention example 12 | 80 | 10 | 2.1 | 12 | SiC | #600 | 1.7 |
| Present invention example 13 | 80 | 10 | 2.1 | 10 | $Al_2O_3$ | #600 | 1.3 |
| Present invention example 14 | 80 | 10 | 2.1 | 10 | SiC | #400 | 1.0 |
| Present invention example 15 | 80 | 10 | 2.1 | 10 | SiC | #800 | 1.3 |
| Comparative example 1 | 20 | 10 | 2.1 | 10 | SiC | #600 | 5.0 |
| Comparative example 2 | 30 | 10 | 2.1 | 10 | SiC | #600 | 4.0 |
| Comparative example 3 | 170 | 10 | 2.1 | 10 | SiC | #600 | 4.1 |
| Comparative example 4 | 200 | 10 | 2.1 | 10 | SiC | #600 | 5.0 |
| Comparative example 5 | 80 | 25 | 0.9 | 10 | SiC | #600 | 5.3 |
| Comparative example 6 | 80 | 20 | 1.1 | 10 | SiC | #600 | 5.7 |
| Comparative example 7 | 80 | 18 | 1.2 | 10 | SiC | #600 | 5.3 |
| Comparative example 8 | 80 | 4 | 5.3 | 10 | SiC | #600 | 4.0 |
| Comparative example 9 | 80 | 3 | 7.1 | 10 | SiC | #600 | 4.7 |
| Comparative example 10 | 80 | 10 | 2.1 | 10 | $B_4C$ | #600 | 5.3 |
| Comparative example 11 | 80 | 10 | 2.1 | 10 | glass | #600 | 5.0 |
| Comparative example 12 | 80 | 10 | 2.1 | 10 | SiC | #200 | 5.7 |
| Comparative example 13 | 80 | 10 | 2.1 | 10 | SiC | #1000 | 5.0 |

Moreover, the ceramic heaters 1 subjected to the blast processing under the conditions shown in Table 1 were disposed in the atmosphere, and the wafers with the size of Ø300 mm were mounted on the surfaces 3*a* of the plate members 3. Then, the heaters were heated up to 500° C., and uniform heating performances (differences between the maximum values and minimum values of the temperatures of the wafers) were measured by a TC wafer that has multiple thermocouples on the wafer.

As shown in Table 1, the ceramic heaters 1 subjected to the blast processing under the conditions of the present invention examples were better in uniform heating performance than those in the cases of the comparative examples. Then, the uniform heating performances of the ceramic heaters 1 became substantially equivalent to those in an unused initial state, and it became possible to sufficiently reuse the ceramic heaters 1.

Example 2

Subsequently, used electrostatic chucks with a size of Ø300 mm were used as the processing objects, and the blast processing was implemented for the electrostatic chucks under conditions shown in Table 2 to be shown below.

TABLE 2

| | Blast pressure ($gf/cm^2$) | Nozzle moving speed (cm/sec) | Amount of blown sand per unit area ($g/cm^2$) | Distance from nozzle end to processing object surface (cm) | Type of blasting material | Grain size of blasting material | Reduction of suction force (%) | Variation of uniform heating performance (° C.) |
|---|---|---|---|---|---|---|---|---|
| Present invention example 1 | 40 | 10 | 2.1 | 10 | SiC | #600 | 4 | 0.0 |
| Present invention example 2 | 80 | 10 | 2.1 | 10 | SiC | #600 | 2 | 0.3 |
| Present invention example 3 | 120 | 10 | 2.1 | 10 | SiC | #600 | 4 | 0.3 |
| Present invention example 4 | 150 | 10 | 2.1 | 10 | SiC | #600 | 5 | 0.3 |
| Present invention example 5 | 80 | 15 | 1.4 | 10 | SiC | #600 | 5 | 0.0 |
| Present invention example 6 | 80 | 12 | 1.8 | 10 | SiC | #600 | 1 | 0.0 |
| Present invention example 7 | 80 | 10 | 2.1 | 10 | SiC | #600 | 3 | 0.3 |
| Present invention example 8 | 80 | 8 | 2.7 | 10 | SiC | #600 | 7 | 0.7 |
| Present invention example 9 | 80 | 5 | 4.3 | 10 | SiC | #600 | 8 | 1.0 |
| Present invention example 10 | 80 | 10 | 2.1 | 6 | SiC | #600 | 7 | 0.3 |
| Present invention example 11 | 80 | 10 | 2.1 | 8 | SiC | #600 | 6 | 0.0 |
| Present invention example 12 | 80 | 10 | 2.1 | 12 | SiC | #600 | 9 | 0.7 |
| Present invention example 13 | 80 | 10 | 2.1 | 10 | $Al_2O_3$ | #600 | 6 | 0.3 |
| Present invention example 14 | 80 | 10 | 2.1 | 10 | SiC | #400 | 4 | 0.0 |
| Present invention example 15 | 80 | 10 | 2.1 | 10 | SiC | #800 | 6 | 0.7 |
| Comparative example 1 | 20 | 10 | 2.1 | 10 | SiC | #600 | 27 | 3.7 |
| Comparative example 2 | 30 | 10 | 2.1 | 10 | SiC | #600 | 21 | 2.3 |
| Comparative example 3 | 170 | 10 | 2.1 | 10 | SiC | #600 | 20 | 2.8 |
| Comparative example 4 | 200 | 10 | 2.1 | 10 | SiC | #600 | 27 | 4.0 |
| Comparative example 5 | 80 | 25 | 0.9 | 10 | SiC | #600 | 30 | 4.7 |
| Comparative example 6 | 90 | 20 | 1.1 | 10 | SiC | #600 | 33 | 5.0 |
| Comparative example 7 | 60 | 18 | 1.2 | 10 | SiC | #600 | 30 | 4.3 |
| Comparative example 8 | 80 | 4 | 5.3 | 10 | SiC | #600 | 20 | 3.0 |
| Comparative example 9 | 80 | 3 | 7.1 | 10 | SiC | #600 | 26 | 3.7 |
| Comparative example 10 | 80 | 10 | 2.1 | 10 | $B_4C$ | #600 | 29 | 4.0 |
| Comparative example 11 | 80 | 10 | 2.1 | 10 | glass | #600 | 29 | 4.3 |
| Comparative example 12 | 80 | 10 | 2.1 | 10 | SiC | #200 | 33 | 5.0 |
| Comparative example 13 | 80 | 10 | 2.1 | 10 | SiC | #1000 | 28 | 4.0 |

While heating the electrostatic chucks subjected to the blast processing under the conditions in Table 2 by means of a lamp of 1500 W in vacuum, suction forces of the electrostatic chucks were measured by using a wafer backside gas pressure measuring method. These suction forces were compared with those of unused electrostatic chucks, and reductions from the suction forces of the unused electrostatic chucks were measured. As a result, according to the present invention examples, the suction forces became equivalent to those of the unused electrostatic chucks, and the uniform heating performances for the wafers also became equivalent to those of the unused electrostatic chucks.

Example 3

Subsequently, used susceptors with a size of Ø200 mm were used as the processing objects, and the blast processing was implemented for the susceptors under conditions shown in Table 3 to be shown below.

TABLE 3

| | Blast pressure ($gf/cm^2$) | Nozzle moving speed (cm/sec) | Amount of blown sand per unit area ($g/cm^2$) | Distance from nozzle end to processing object surface (cm) | Type of blasting material | Grain size of blasting material | Element on tape adhered |
|---|---|---|---|---|---|---|---|
| Present invention example 1 | 40 | 10 | 2.1 | 10 | SiC | #600 | — |
| Present invention example 2 | 80 | 10 | 2.1 | 10 | SiC | #600 | — |
| Present invention example 3 | 120 | 10 | 2.1 | 10 | SiC | #600 | — |
| Present invention example 4 | 150 | 10 | 2.1 | 10 | SiC | #600 | — |
| Present invention example 5 | 80 | 15 | 1.4 | 10 | SiC | #600 | — |
| Present invention example 6 | 80 | 12 | 1.8 | 10 | SiC | #600 | — |
| Present invention example 7 | 80 | 10 | 2.1 | 10 | SiC | #600 | — |
| Present invention example 8 | 80 | 8 | 2.7 | 10 | SiC | #600 | — |
| Present invention example 9 | 80 | 5 | 4.3 | 10 | SiC | #600 | — |
| Present invention example 10 | 80 | 10 | 2.1 | 6 | SiC | #600 | — |
| Present invention example 11 | 80 | 10 | 2.1 | 8 | SiC | #600 | — |
| Present invention example 12 | 80 | 10 | 2.1 | 12 | SiC | #600 | — |
| Present invention example 13 | 80 | 10 | 2.1 | 10 | $Al_2O_3$ | #600 | — |
| Present invention example 14 | 80 | 10 | 2.1 | 10 | SiC | #400 | — |
| Present invention example 15 | 80 | 10 | 2.1 | 10 | SiC | #800 | — |
| Comparative example 1 | 20 | 10 | 2.1 | 10 | SiC | #600 | Al, F |
| Comparative example 2 | 30 | 10 | 2.1 | 10 | SiC | #600 | Al, F |
| Comparative example 3 | 170 | 10 | 2.1 | 10 | SiC | #600 | Si, C |
| Comparative example 4 | 200 | 10 | 2.1 | 10 | SiC | #600 | Si, C |
| Comparative example 5 | 80 | 25 | 0.9 | 10 | SiC | #600 | Al, F |
| Comparative example 6 | 80 | 20 | 1.1 | 10 | SiC | #600 | Al, F |
| Comparative example 7 | 80 | 18 | 1.2 | 10 | SiC | #600 | Si, C |

TABLE 3-continued

| | Blast pressure (gf/cm$^2$) | Nozzle moving speed (cm/sec) | Amount of blown sand per unit area (g/cm$^2$) | Distance from nozzle end to processing object surface (cm) | Type of blasting material | Grain size of blasting material | Element on tape adhered |
|---|---|---|---|---|---|---|---|
| Comparative example 8 | 80 | 4 | 5.3 | 10 | SiC | #600 | Si, C |
| Comparative example 9 | 80 | 3 | 7.1 | 10 | SiC | #600 | 4.7 |
| Comparative example 10 | 80 | 10 | 2.1 | 10 | $B_4C$ | #600 | B, C |
| Comparative example 11 | 80 | 10 | 2.1 | 10 | glass | #600 | Al, F |
| Comparative example 12 | 80 | 10 | 2.1 | 10 | SiC | #200 | — |
| Comparative example 13 | 80 | 10 | 2.1 | 10 | SiC | #1000 | Al, F |

Adhesive tapes were put onto and peeled from the surfaces 3*a* of the susceptors subjected to the blast processing under the conditions in Table 3, and were observed by means of SEM/EDS. As a result, when the blast processing was performed under the conditions of the present invention examples, the blasting materials 19 or the deposits were not detected. Meanwhile, in the cases of the comparative examples, Al, F, Si, and C, which are components of the deposits, were detected. It is assumed that Al was from aluminum nitride as a component of the electrostatic chucks, that F was generated from gas for use in the CVD processing, and that Si and C are components of the blasting material 19.

Example 4

Subsequently, used electrostatic chucks with a size of Ø200 mm were used as the processing objects, and the blast processing was implemented for the electrostatic chucks under conditions shown in Table 4 to be shown below.

TABLE 4

| | Blast pressure (gf/cm$^2$) | Nozzle moving speed (cm/sec) | Amount of blown sand per unit area (g/cm$^2$) | Distance from nozzle end to processing object surface (cm) | Type of blasting material | Grain size of blasting material | Particle count |
|---|---|---|---|---|---|---|---|
| Present invention example 1 | 40 | 10 | 2.1 | 10 | SiC | #600 | 3284 |
| Present invention example 2 | 80 | 10 | 2.1 | 10 | SiC | #600 | 3386 |
| Present invention example 3 | 120 | 10 | 2.1 | 10 | SiC | #600 | 4209 |
| Present invention example 4 | 150 | 10 | 2.1 | 10 | SiC | #600 | 3501 |
| Present invention example 5 | 80 | 15 | 1.4 | 10 | SiC | #600 | 4344 |
| Present invention example 6 | 80 | 12 | 1.8 | 10 | SiC | #600 | 4659 |
| Present invention example 7 | 80 | 10 | 2.1 | 10 | SiC | #600 | 4720 |
| Present invention example 8 | 80 | 8 | 2.7 | 10 | SiC | #600 | 3893 |
| Present invention example 9 | 80 | 5 | 4.3 | 10 | SiC | #600 | 5830 |
| Present invention example 10 | 80 | 10 | 2.1 | 6 | SiC | #600 | 4502 |
| Present invention example 11 | 80 | 10 | 2.1 | 8 | SiC | #600 | 3987 |
| Present invention example 12 | 80 | 10 | 2.1 | 12 | SiC | #600 | 3725 |

TABLE 4-continued

| | Blast pressure ($gf/cm^2$) | Nozzle moving speed (cm/sec) | Amount of blown sand per unit area ($g/cm^2$) | Distance from nozzle end to processing object surface (cm) | Type of blasting material | Grain size of blasting material | Particle count |
|---|---|---|---|---|---|---|---|
| Present invention example 13 | 80 | 10 | 2.1 | 10 | $Al_2O_3$ | #600 | 4209 |
| Present invention example 14 | 80 | 10 | 2.1 | 10 | SiC | #400 | 4298 |
| Present invention example 15 | 80 | 10 | 2.1 | 10 | SiC | #800 | 3926 |
| Comparative example 1 | 20 | 10 | 2.1 | 10 | SiC | #600 | immeasurable |
| Comparative example 2 | 30 | 10 | 2.1 | 10 | SiC | #600 | immeasurable |
| Comparative example 3 | 170 | 10 | 2.1 | 10 | SiC | #600 | 10021 |
| Comparative example 4 | 200 | 10 | 2.1 | 10 | SiC | #600 | 12098 |
| Comparative example 5 | 80 | 25 | 0.9 | 10 | SiC | #600 | immeasurable |
| Comparative example 6 | 80 | 20 | 1.1 | 10 | SiC | #600 | immeasurable |
| Comparative example 7 | 80 | 18 | 1.2 | 10 | SiC | #600 | immeasurable |
| Comparative example 8 | 80 | 4 | 5.3 | 10 | SiC | #600 | 11237 |
| Comparative example 9 | 80 | 3 | 7.1 | 10 | SiC | #600 | 16382 |
| Comparative example 10 | 80 | 10 | 2.1 | 10 | $B_4C$ | #600 | 16498 |
| Comparative example 11 | 80 | 10 | 2.1 | 10 | glass | #600 | immeasurable |
| Comparative example 12 | 80 | 10 | 2.1 | 10 | SiC | #200 | 13902 |
| Comparative example 13 | 80 | 10 | 2.1 | 10 | SiC | #1000 | immeasurable |

Si wafers were sucked onto the electrostatic chucks subjected to the blast processing under the conditions shown in Table 4, and particle amounts on back surfaces of the Si wafers were measured by means of a particle counter.

When the blast processing was implemented under the conditions of the present invention examples in Table 4, the particle amounts were small.

Meanwhile, when the blast processing was implemented under the conditions shown in the comparative examples, the particle amounts were increased as compared with those in the present invention examples. This is assumed to be caused by the following phenomenon. Specifically, in addition to the particles of the blasting material 19 remaining on the surfaces of the electrostatic chucks, the aluminum nitride itself was formed into particles owing to grain separation and the like as a result of damage to the surfaces of the electrostatic chucks, or the back surfaces of the wafers were damaged to some extent since the surface roughness of the electrostatic chuck became too large.

Moreover, the suction forces of the electrostatic chucks were not generated sufficiently in a part of the comparative examples, and there, it became difficult to suck the wafers. Accordingly, it was impossible to measure the particle amounts.

What is claimed is:

1. A blast processing method, comprising:

blowing a blasting material that is abrasive grains made of silicon carbide or aluminum oxide and having a grain size of #400 to #800 onto the surface of the processing object while setting, at 40 to 150 $gf/cm^2$, a blast pressure when the blasting material collides with the surface of the processing object, wherein the blasting material removes a deposition adhered onto a surface of a processing object formed of aluminum nitride.

2. The blast processing method according to claim 1, wherein the blast pressure is set at 60 to 100 $gf/cm^2$.

3. The blast processing method according to claim 1, wherein a blowing amount of the blasting material per unit area on the surface of the processing object is set at 1.4 to 4.3 $g/cm^2$.

4. The blast processing method according to claim 1, wherein a blowing amount of the blasting material per unit area on the surface of the processing object is set at 1.7 to 2.8 $g/cm^2$.

* * * * *